US010788175B2

(12) United States Patent
Li

(10) Patent No.: US 10,788,175 B2
(45) Date of Patent: Sep. 29, 2020

(54) LED LAMP BOX AND DISPLAY DEVICE

(71) Applicant: BLUEVIEW ELEC-OPTIC TECH CO., LTD., Shuangliu Chengdu, Sichuan (CN)

(72) Inventor: Zhongxun Li, Sichuan (CN)

(73) Assignee: Blueview Elec-Optic Tech Co., Ltd., Shuangliu Chengdu, Sichuan (CN)

( * ) Notice: Subject to any disclaimer, the term of this patent is extended or adjusted under 35 U.S.C. 154(b) by 323 days.

(21) Appl. No.: 15/776,816

(22) PCT Filed: Apr. 21, 2017

(86) PCT No.: PCT/CN2017/081517
§ 371 (c)(1),
(2) Date: May 17, 2018

(87) PCT Pub. No.: WO2018/170993
PCT Pub. Date: Sep. 27, 2018

(65) Prior Publication Data

US 2020/0200338 A1 Jun. 25, 2020

(30) Foreign Application Priority Data

Mar. 22, 2017 (CN) ..... 2017 1 0172042

(51) Int. Cl.
*F21S 4/28* (2016.01)
*F21V 23/06* (2006.01)
(Continued)

(52) U.S. Cl.
CPC ..... *F21S 4/28* (2016.01); *F21V 19/004* (2013.01); *F21V 21/096* (2013.01); *F21V 23/06* (2013.01); *F21Y 2115/10* (2016.08)

(58) Field of Classification Search
CPC ..... F21S 4/28; F21V 19/004
(Continued)

(56) References Cited

U.S. PATENT DOCUMENTS 7,611,260 B1 * 11/2009 Lin ..... F21V 29/83 362/224
10,378,742 B1 * 8/2019 Rao ..... H01B 7/0045
(Continued)

FOREIGN PATENT DOCUMENTS

CN 201129638 Y 10/2008
CN 201319242 Y 9/2009
(Continued)

OTHER PUBLICATIONS

International Search Report, PCT/CN2017/081517, dated Oct. 11, 2017, with English translation, 7 pages.
(Continued)

*Primary Examiner* — Christopher M Raabe
(74) *Attorney, Agent, or Firm* — Leydig, Voit & Mayer, Ltd.

(57) ABSTRACT

An LED lamp box and a display device. The LED lamp box includes a lamp box support, a canvas, a controller and multiple LED light source modules. The multiple LED light source modules are fixed on the lamp box support, and the canvas covers the multiple LED light source modules and is fixed to the lamp box support. The LED light source modules are electrically connected with each other. Each LED light source module comprises multiple LED lamp strips arranged in parallel and lamp-strip PCB connectors for connecting the LED lamp strips. The LED lamp strip is provided with an input port and an output port, and each LED lamp strip comprises multiple LED lamps connected in series. The controller is electrically connected with the LED light source modules to control the LED lamps by scanning the LED light source modules line by line.

20 Claims, 5 Drawing Sheets

(51) Int. Cl.
*F21V 19/00* (2006.01)
*F21V 21/096* (2006.01)
*F21Y 115/10* (2016.01)

(58) Field of Classification Search
USPC ..... 362/227
See application file for complete search history.

(56) References Cited

U.S. PATENT DOCUMENTS

| | | | | |
|---|---|---|---|---|
| 2007/0247847 | A1 | 10/2007 | Villard | |
| 2010/0033964 | A1* | 2/2010 | Choi | F21K 9/00 362/234 |
| 2011/0309745 | A1* | 12/2011 | Westermarck | F21V 29/74 315/51 |
| 2014/0247593 | A1* | 9/2014 | Yu | F21V 23/04 362/249.02 |
| 2016/0223152 | A1* | 8/2016 | Baright | F21V 19/003 |
| 2017/0328544 | A1* | 11/2017 | Gergely | F21V 19/004 |

FOREIGN PATENT DOCUMENTS

| | | | | |
|---|---|---|---|---|
| CN | 202074315 | U | 12/2011 | |
| CN | 204706300 | U | 10/2015 | |
| CN | 204706301 | U | 10/2015 | |
| WO | WO-2011127658 | A1 * | 10/2011 | G09F 13/22 |

OTHER PUBLICATIONS

Written Opinion, PCT/CN2017/081517, dated Oct. 11, 2017, 4 pages (in Chinese).

* cited by examiner

LED LAMP BOX AND DISPLAY DEVICE

CROSS-REFERENCE TO RELATED APPLICATIONS

The present application is the U.S. national phase of International Application No. PCT/CN2017/081517, filed on Apr. 21, 2017, which claims the priority to Chinese patent application with the filing No. CN201710172042.7, filed with the State Intellectual Property Office on Mar. 22, 2017, entitled "LED Lamp Box and Display Device", the entire contents of which are incorporated herein by reference in their entireties for all purposes.

TECHNICAL FIELD

The present disclosure relates to the technical field of lamp boxes, and particularly to an LED (light emitting diode) lamp box and a display device.

BACKGROUND ART

At present, in order to improve the publicity effect of a product, the general practice of the manufacturer is to improve the brightness of the LED lamps in the LED lamp box. However, although the contrast between the LED lamp box and the surrounding environment is improved by doing this, the improvement in publicity effect is limited, and more energy is wasted. Consequently, the method of making the lamp box twinkle is used for some LED lamp boxes. However, although this method improves the contrast between the lamp boxes and the surrounding environment, it cannot produce colorful dynamic effect.

SUMMARY

In order to overcome the above defects in the prior art, embodiments of the present disclosure provide an LED lamp box and a display device, which can achieve high gray level, enable the contents to be publicized and expressed in a colorful and dynamic way, and save energy while enabling the LED lamp box to show a colorful dynamic effect.

In order to achieve the above object, the technical solution provided by a preferred embodiment of the present disclosure is as follows:

A preferred embodiment of the present disclosure provides an LED lamp box. The LED lamp comprises a lamp box support, a canvas, a controller and a plurality of LED light source modules.

The plurality of LED light source modules are fixed on the lamp box support, and the canvas covers the plurality of LED light source modules and is fixed to the lamp box support.

The LED light source modules are electrically connected with each other.

Each of the LED light source modules comprises a plurality of LED lamp strips arranged in parallel and lamp-strip PCB (printed circuit board) connectors for connecting the LED lamp strips. Each LED lamp strip is provided with an input port and an output port, and each LED lamp strip comprises a plurality of LED lamps connected in series.

The controller is electrically connected with the LED light source modules, so as to control the LED lamps in the LED light source modules by scanning the LED light source modules line by line.

In a preferred embodiment of the present disclosure, the plurality of LED light source modules are arranged in a matrix form.

In a preferred embodiment of the present disclosure, the LED lamp strips in any two LED light source modules are parallel to each other.

In a preferred embodiment of the present disclosure, two adjacent LED light source modules are electrically connected with each other through power lines and/or signal lines.

In a preferred embodiment of the present disclosure, each of the LED light source modules comprises two lamp-strip PCB connectors, and the lamp-strip PCB connectors in two adjacent LED light source modules are electrically connected with each other through power lines and signal lines.

In a preferred embodiment of the present disclosure, one lamp-strip PCB connector in each LED light source module is electrically connected with one lamp-strip PCB connector of an adjacent LED light source module by using the power lines, and the other lamp-strip PCB connector in each LED light source module is connected, by using the signal lines, with the other lamp-strip PCB connector in the adjacent LED light source module.

In a preferred embodiment of the present disclosure, in each LED light source module, the two lamp-strip PCB connectors are provided perpendicular to the LED lamp strips, and the two lamp-strip PCB connectors are spaced from each other.

In a preferred embodiment of the present disclosure, the LED lamp box further comprises metal wires and fasteners. Each metal wire is provided on the LED light source module in an extending direction of the LED lamp strip and is fixed to the lamp box support, and each fastener is provided on the metal wire and is snap-fixed to the lamp-strip PCB connector.

In a preferred embodiment of the present disclosure, the LED lamp box further comprises metal tubes and magnets. Each metal tube is provided on the LED light source module in the extending direction of the LED lamp strip and is fixed to the lamp box support, and each magnet is provided on the metal tube and is magnetically attached to the lamp-strip PCB connector.

In a preferred embodiment of the present disclosure, a linear constant-current driving circuit is provided on the lamp-strip PCB connectors, and the linear constant-current driving circuit is electrically connected with the LED lamp strips, so that the LED lamps in the LED lamp strips operate at a constant current.

In a preferred embodiment of the present disclosure, a light absorption layer is provided between the LED light source modules and the lamp box support.

In a preferred embodiment of the present disclosure, spacings between any two adjacent LED lamps on the LED lamp strip are equal, and the plurality of LED lamp strips are fixed on the lamp box support at equal intervals.

In a preferred embodiment of the present disclosure, the input port and the output port of the LED lamp strip are electrically connected with the lamp-strip PCB connectors through pins and/or SMT (surface mounted technology) patches.

In a preferred embodiment of the present disclosure, the canvas is snap-fixed to the lamp box support.

A preferred embodiment of the present disclosure further provides a display device. The display device comprises a power supply and the LED lamp box(es) described above, with the power supply being electrically connected with the LED lamp box(es) for supplying power to the LED lamp box(es).

Compared with the prior art, the present disclosure has the following advantageous effects:

For the LED lamp box and the display device provided by the present disclosure, the LED lamp box is provided with a lamp box support, a canvas, a controller and a plurality of LED light source modules; the plurality of LED light source modules are fixed on the lamp box support, and the canvas covers the plurality of LED light source modules and is fixed to the lamp box support; the LED light source modules are electrically connected with each other; each of the LED light source modules comprises a plurality of LED lamp strips arranged in parallel and lamp-strip PCB connectors for connecting the LED lamp strips; the LED lamp strip is provided with an input port and an output port, and each LED lamp strip comprises a plurality of LED lamps connected in series; and the controller is electrically connected with the LED light source modules so as to control the LED lamps in the LED light source modules by scanning the LED light source modules line by line. This design can achieve high gray level, enable the contents to be publicized and expressed in a colorful and dynamic way, and save energy while enabling the LED lamp box to show a colorful dynamic effect.

BRIEF DESCRIPTION OF DRAWINGS

In order to more clearly illustrate the technical solutions of the embodiments of the present disclosure, brief description is made below on the drawings required to be used in the embodiments. It should be understood that the following drawings only illustrate some of the embodiments of the present disclosure and shall not be regarded as a limitation to the scope, and for a person of ordinary skills in the art, other related drawings may be obtained from these drawings without using inventive efforts.

Figure 1:
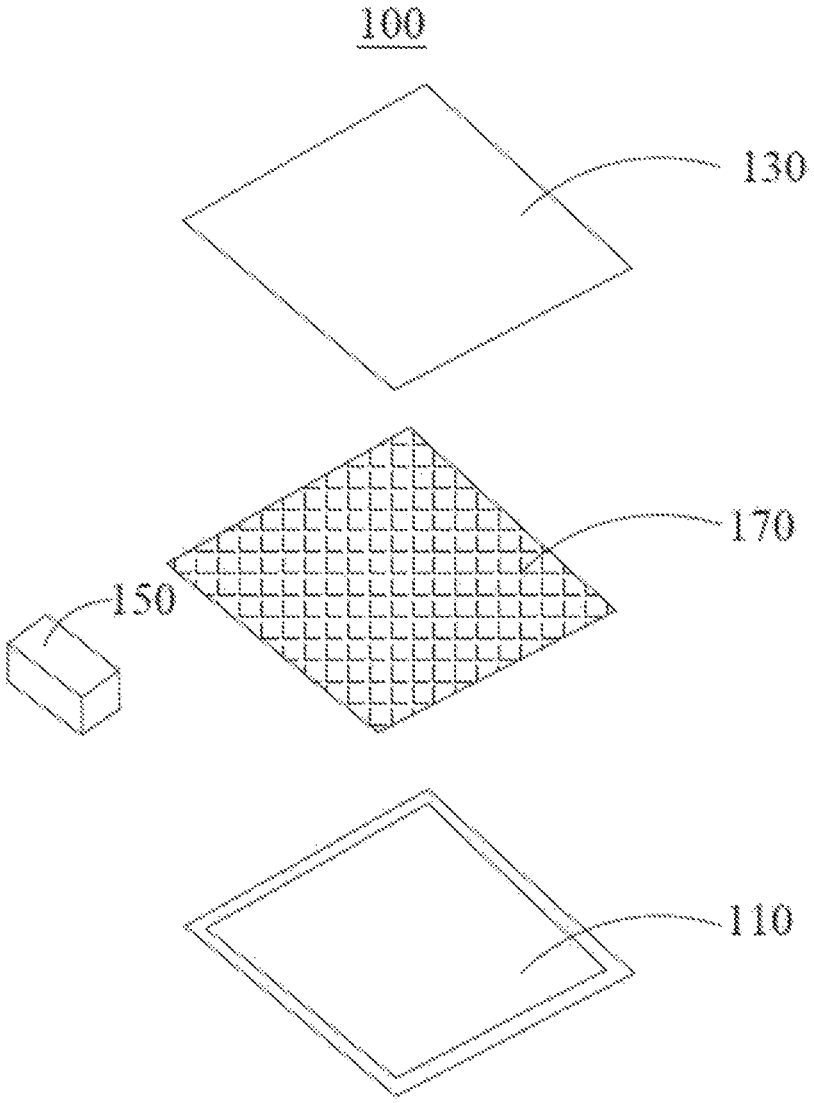
FIG. 1 is an exploded structural diagram of an LED lamp box according to preferred embodiments of the present disclosure.

Reference signs: 100—LED lamp box; 110—lamp box support; 120—light absorption layer; 130—canvas; 150—controller; 170—LED light source module; 180—metal wire; 181—fastener; 190—metal tube; 191—magnet; 171—LED lamp strip; 172—lamp-strip PCB connector; 173—LED lamp; 174—power line; and 175—signal line.

DETAILED DESCRIPTION OF EMBODIMENTS

In order to make the objects, technical solutions and advantages of the embodiments of the present disclosure clearer, the technical solutions of the embodiments of the present disclosure will be described clearly and completely below with reference to the drawings of the embodiments of the present disclosure. Apparently, the embodiments described are some of the embodiments of the present disclosure, rather than all of the embodiments. The components of the embodiments of the present disclosure described and illustrated in the drawings herein can generally be arranged and designed in a variety of different configurations.

Thus, the following detailed description of the embodiments of the present disclosure provided in the drawings is not intended to limit the scope of protection of the present disclosure, but is merely representative of the selected embodiments of the present disclosure. All the other embodiments that are obtained by a person skilled in the art without inventive effort on the basis of the embodiments of the present disclosure shall be covered by the scope of protection of the present disclosure.

It should be noted that like reference signs and letters denote like items in the drawings, and therefore, once a certain item is defined in one figure, it does not need to be further defined and explained in the following figures. It should be further noted that the various embodiments in the present description are all described in a progressive manner, each embodiment focuses on the aspects differs from other embodiments, and as to the same or similar aspects among the embodiments, mutual reference can be made.

In the description of the present disclosure, it is to be understood that the orientation or position relation denoted by the terms such as "center", "upper", "lower", "left", "right", "vertical", "horizontal", "inner" and "outer" is based on the orientation or position relation indicated by the figures, or refers to the orientation or position where the product of the present disclosure is normally placed when in use, which only serves to facilitate describing the present disclosure and simplify the description, rather than indicating or suggesting that the device or element referred to must have a particular orientation, and is constructed and operated in a particular orientation, and therefore cannot be construed as a limitation on the present disclosure. In addition, the terms such as "first", "second" and "third" are only used for differentiated description and cannot be understood as an indication or implication of importance in relativity.

In addition, the terms such as "horizontal", "vertical" and "pendulous" do not necessarily require that the components must be absolutely horizontal or pendulous, rather, they can be slightly inclined. For example, the term "horizontal" merely refers to a horizontal direction relative to the direction indicated by the term "vertical", and does not necessarily require that the structure must be absolutely horizontal, rather, it can be slightly inclined.

In the description of the present disclosure, it should be further noted that unless otherwise explicitly specified and defined, the terms "arrange", "install", "link" and "connect" shall be understood in broad sense, which may, for example, refer to fixed connection, detachable connection or integral connection; may refer to mechanical connection or electrical connection; may refer to direct connection or indirect connection by means of an intermediate medium; and may refer to communication between two elements. A person of ordinary skills in the art could understand the specific meaning of the terms in the present disclosure according to specific situations.

Some of the embodiments of the present disclosure are described in detail below with reference to the drawings. The following embodiments and the features of the embodiments can be combined with each other if there is no conflict.

Referring to FIG. 1, FIG. 1 is an exploded structural diagram of an LED lamp box 100 according to preferred embodiments of the present disclosure. In the present embodiment, the LED lamp box 100 may be applied to wedding photography, household decorative painting, indoor and outdoor signage, large-scale exhibition projects or exhibition activities, wall decoration and publicity for shopping malls, banks, guesthouses, hotels, etc., advertising media of airports, subways, stations, bus stops, etc., craft gifts, mobile billboards, etc. In the present embodiment, the application scope of the LED lamp box 100 is not specifically limited.

As shown in FIG. 1, the LED lamp box 100 may comprise a lamp box support 110, a canvas 130, a controller 150 and a plurality of LED light source modules 170.

Specifically, in the present embodiment, the plurality of LED light source modules 170 are fixed on the lamp box support 110, and the canvas 130 covers the plurality of LED light source modules 170 and is fixed to the lamp box support 110.

There may be many ways to fix the canvas 130 to the lamp box support 110, for example, in one implementation of the present embodiment, the lamp box support 110 may be provided with a mounting groove for mounting the canvas 130, and the canvas 130 may be fixed to the lamp box support 110 by being clamped in the mounting groove.

Figure 2:
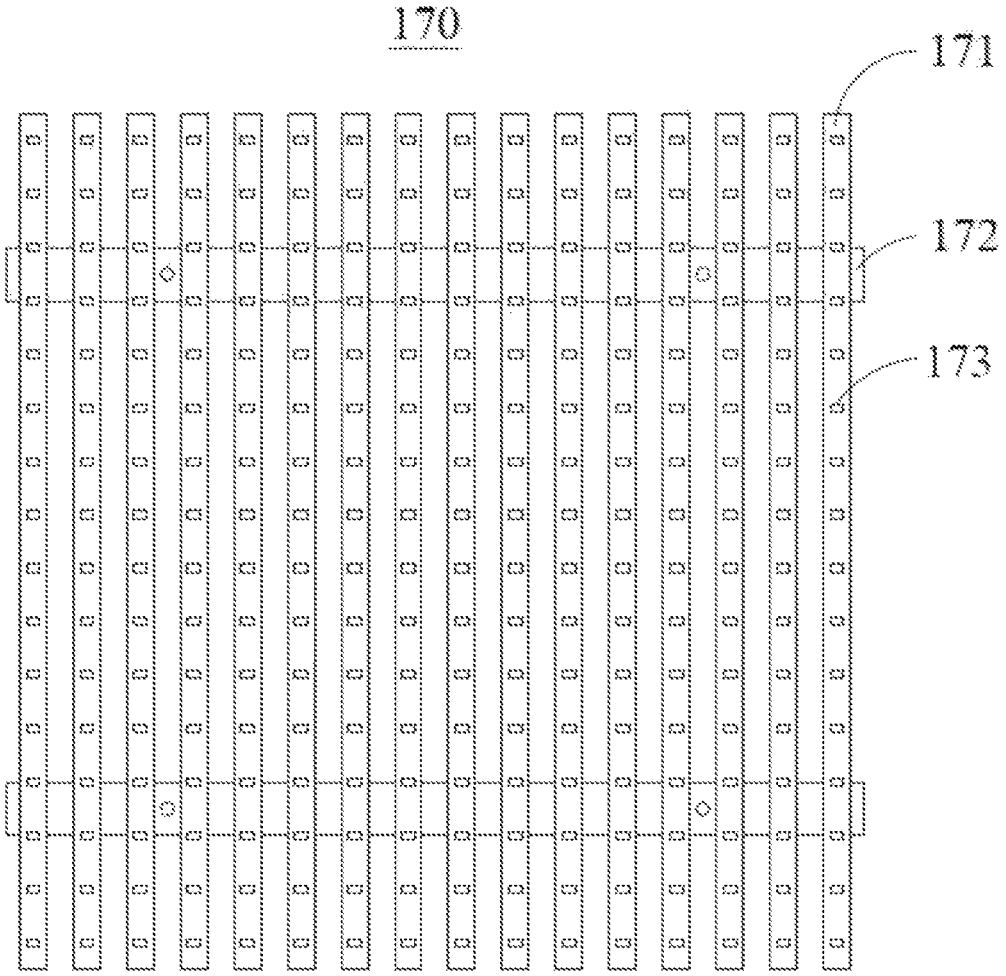
FIG. 2 is a schematic structural diagram, at a first view angle, of an LED light source module according to preferred embodiments of the present disclosure.
Figure 3:
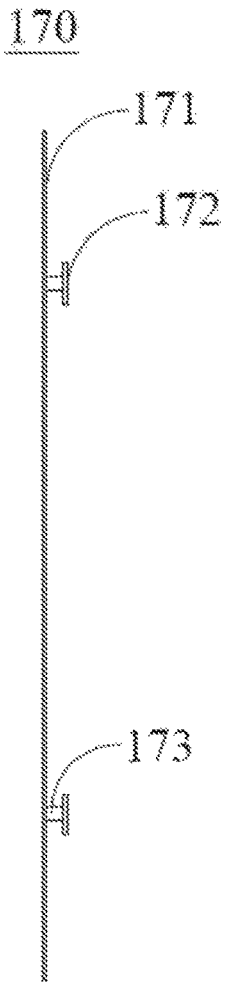
FIG. 3 is a schematic structural diagram, at a second view angle, of the LED light source module according to preferred embodiments of the present disclosure.

The controller 150 is electrically connected with the LED light source modules 170, and can be used for controlling the LED light source modules 170. Optionally, reference is made to FIG. 2 and FIG. 3 for the structure of the LED light source module 170. Each of the LED light source modules 170 can comprise a plurality of LED lamp strips 171 arranged in parallel and lamp-strip PCB connectors 172 for connecting the LED lamp strips 171, the LED lamp strip 171 is provided with an input port and an output port, the input port and the output port can be electrically connected with the lamp-strip PCB connectors 172 through pins and/or SMT patches. As shown in FIG. 2, the lamp-strip PCB connectors 172 extend in a direction perpendicular to the LED lamp strips 171. The lamp-strip PCB connectors 172 are located at the same side of the LED lamp strips 171. All the LED lamp strips 171 in each LED light source module are connected to the lamp-strip PCB connectors 172. The connection mode enables convenient production, simple assembly, reliable connection, high precision, etc.

It can be easily understood that the lamp-strip PCB connectors 172 may be provided not perpendicular to the LED lamp strips 171, as long as all LED lamp strips 171 in each LED light source module 170 are connected to the lamp-strip PCB connectors 172. Additionally, the LED lamp strips 171 in each LED light source module may also not parallel to each other, wherein each LED lamp strip 171 may be in a linear form, or may be in a broken line form or a curved line form, enabling all the LED lamp strips 171 to be combined to form an ornamental form. In this way, the LED lamp strips 171 may show more colorful patterns during operation.

Further, as a preferred implementation mode, the input port and the output port can be electrically connected with the lamp-strip PCB connector 172 through SMT patches. The use of SMT patches enables simple production process and high production efficiency.

In the present embodiment, a printed circuit board (PCB) can be used as the lamp-strip PCB connector 172.

Further, each LED lamp strip 171 comprises a plurality of LED lamps 173 connected in series. The controller 150 can control the LED light source modules 170 by scanning the LED light source modules 170 line by line. Optionally, during the line-by-line scanning, the controller 150 can achieve the control over the whole LED light source modules 170 by controlling the on/off of the LED lamps 173 in each LED lamp strip 171, and optionally, the line scanning direction is the extending direction of the LED lamp strip 171.

In the present embodiment, as an implementation mode, the LED lamp 173 can be an SMD (surface mounted device)-patch LED lamp, and the SMD-patch LED lamp has the advantages of long service life, quick response speed, high electro-optical conversion efficiency, low power consumption, high reliability, being miniaturized, thin and lightweight and having no shape limitation.

In addition, if all of the LED lamps 173 are connected in series, a relatively high voltage needs to be output to the LED lamps 173; and if all of the LED lamps 173 are connected in parallel, relatively large current needs to be output to the LED lamps 173. Moreover, connecting all the LED lamps 173 in series or in parallel not only limits the number of the LED lamps 173 used, but also leads to relatively large load current of the parallel LED lamps 173. In view of this, a linear constant-current driving circuit may be provided on the lamp-strip PCB connectors 172, which can ensure that the LED lamps 173 in the LED lamp strips 171 operate at a constant current, so as to solve the technical problem that the LED lamps 173 have high power consumption and low working efficiency when they are directly connected in series or in parallel.

In the present embodiment, the number of the LED lamp strips 171 can be set according to actual design requirements, which is not limited in this embodiment. As an implementation mode, 16 LED lamp strips 171 can be provided. Optionally, the 16 LED lamp strips 171 are parallel to each other, and spacings between any two adjacent LED lamp strips 171 are equal, so as to achieve the uniform arrangement of the LED lamp strips 171.

Figure 4:
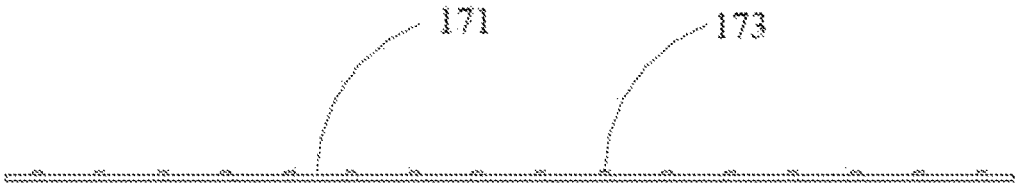
FIG. 4 is a schematic structural diagram, at a first view angle, of an LED lamp strip according to preferred embodiments of the present disclosure.
Figure 5:
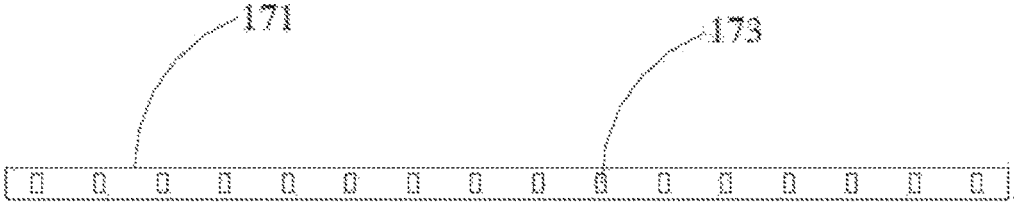
FIG. 5 is a schematic structural diagram, at a second view angle, of the LED lamp strip according to preferred embodiments of the present disclosure.

Further, reference is made to FIG. 4 and FIG. 5 for the specific structure of the LED lamp strip 171, in which the LED lamp strip 171 is uniformly provided with a plurality of LED lamps 173. In the present embodiment, as a preferred implementation mode, the LED lamps 173 can be set to have the same shape and size, and adjacent LED lamps 173 are spaced at the same interval. In addition, in the present embodiment, the LED lamps 173 on adjacent LED lamp strips 171 are in one-to-one correspondence. Referring to FIG. 2, the one-to-one correspondence can be specifically set as follows: after the plurality of LED lamp strips 171 are arranged in parallel, the connection lines between each pair of corresponding LED lamps 173 on the adjacent LED lamp strips 171 are parallel to each other, and further, as a preferred implementation mode, the connection lines between each pair of corresponding LED lamps 173 on the adjacent LED lamp strips 171 are parallel to each other and can be perpendicular to the extending direction of the LED lamp strips 171.

Figure 6:
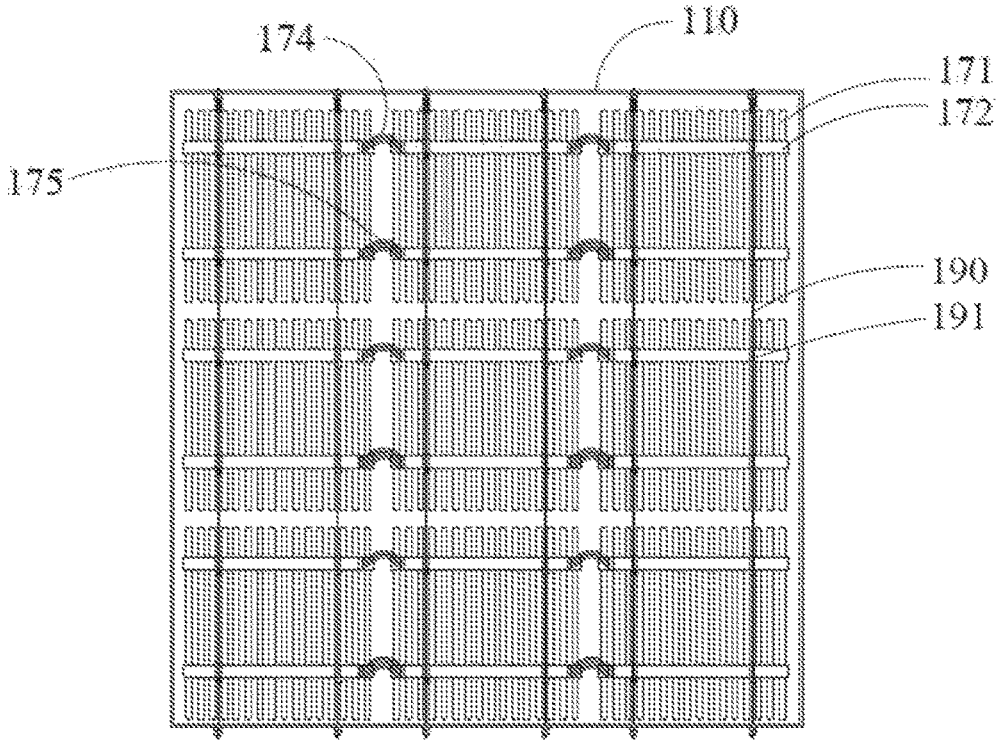
FIG. 6 is a schematic structural diagram showing connection of LED light source modules according to preferred embodiments of the present disclosure.
Figure 7:
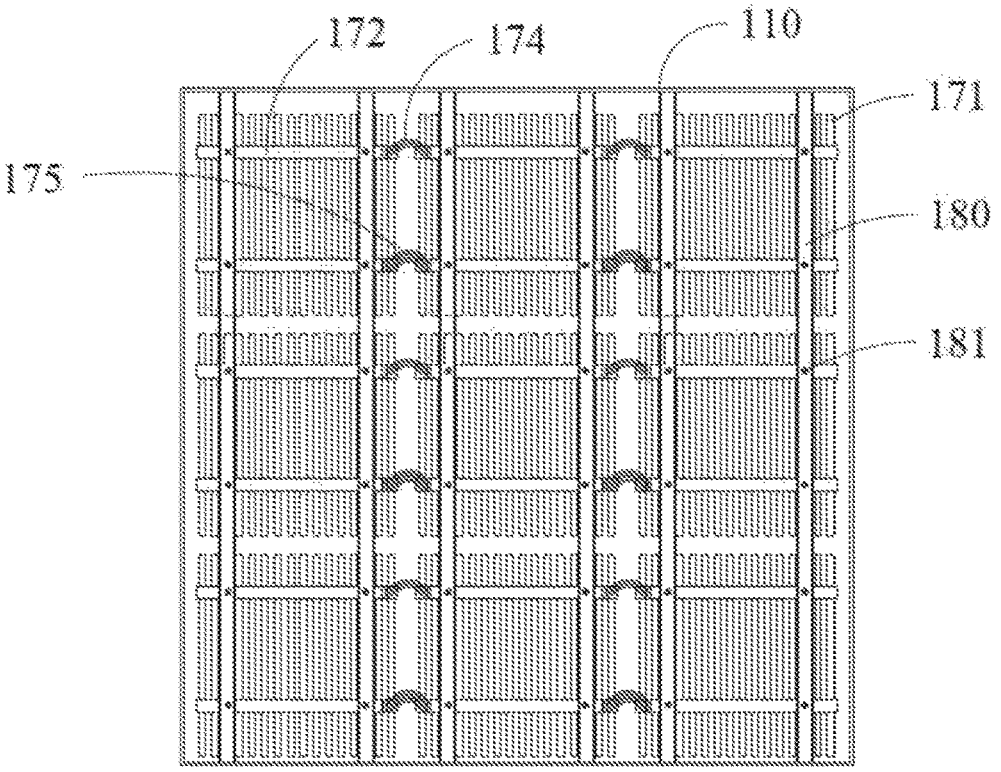
FIG. 7 is another schematic structural diagram showing connection of the LED light source modules according to preferred embodiments of the present disclosure.

Further, one manner of fixing the LED light source modules 170 to the lamp box support 110 is shown in FIG. 6. The plurality of LED light source modules 170 may be arranged in a matrix form, and the LED lamp strips 171 in any two LED light source modules 170 are parallel to each other. That is to say, all LED lamp strips 171 in the LED lamp box 100 are parallel to each other. In this way, a large number of LED light source module 170 may be arranged, so that the LED lamp box 100 include more LED lamps 173, improving the gray level of the LED lamp box 100 and thus enabling the LED lamp box 100 colorful.

Each LED light source module 170 may comprises two lamp-strip PCB connectors 172. The two lamp-strip PCB connectors 172 in each LED light source module 170 are perpendicular to the LED lamp strips 171, and the two lamp-strip PCB connectors 172 are spaced from each other.

The lamp-strip PCB connectors 172 in two adjacent LED light source modules 170 are electrically connected with each other through power lines 174 and/or signal lines 175. Optionally, one lamp-strip PCB connector 172 in each LED light source module 170 is electrically connected with one lamp-strip PCB connector 172 of an adjacent LED light source module 170 by using the power lines 174, and the other lamp-strip PCB connector 172 in each LED light source module 170 is connected with the other lamp-strip PCB connector 172 in the adjacent LED light source module 170 by using the signal lines 175, such that the controller 150 is able to flexibly control brightness of individual LED lamps 173, so as to enable the LED lamp box 100 to show colorful and dynamic effects.

The LED lamp box 100 can further comprise metal wires 180 and fasteners 181. The metal wire 180 is provided on the LED light source module 170 in the extending direction of the LED lamp strip 171 and is fixedly connected to the two opposite ends of the lamp box support 110, and the fastener 181 is provided on the metal wire 180 and is snap-fixed to the lamp-strip PCB connector 172.

In the present embodiment, the metal wire 180 can be, but is not limited to, an iron wire, a copper wire, a steel wire, a nickel wire and the like. Preferably, the metal wire 180 can be a steel wire.

Optionally, as an implementation mode of the present embodiment, a fool-proof double-end connecting line can be used as the power line 174, and a combination of an insulation displacement connector and a gray flat cable can be used as the signal line 175.

Further, another manner of fixing the LED light source modules 170 to the lamp box support 110 is shown in FIG. 6. The LED lamp box 100 can further comprise metal tubes 190 and magnets 191. Optionally, in the present embodiment, the metal tube 190 can be provided on the LED light source module 170 in the extending direction of the LED lamp strip 171 and is fixedly connected to the two opposite ends of the lamp box support 110, and the magnet 191 is provided on the metal tube 190 and is magnetically attached to the lamp-strip PCB connector 172, thereby achieving fixing of the LED light source modules 170.

In the present embodiment, the metal tube 190 can be, but is not limited to, a steel tube, an iron tube, a copper tube and the like. Preferably, in order to ensure the reliability of fixing of the LED light source modules 170, a galvanized steel tube can be used as the metal tube 190, and the galvanized steel tube can be a welded steel tube with a hot-dipped or electroplated zinc coating on its surface. In the above, galvanization can increase the corrosion resistance of the steel tube, so as to prolong the service life, and ensure the reliability of fixing.

Accordingly, in the present embodiment, as to the magnet 191, a permanent magnet can be used as a source of magnetic force.

It can be easily understood that there may be many manners for fixing the LED light source modules 170 onto the lamp box support 110, for example, providing fasteners on the lamp box support 110 to snap-fix the LED light source modules 170 to the lamp box support 110; or providing slots at opposite two sides of the lamp box support 110, so that the opposite two ends of the LED light source modules 170 may slide into the slots to achieve fixed connection. Similarly, the lamp-strip PCB connectors 172 may be fixedly mounted on the lamp box support 110 by similar or other manners.

Figure 8:
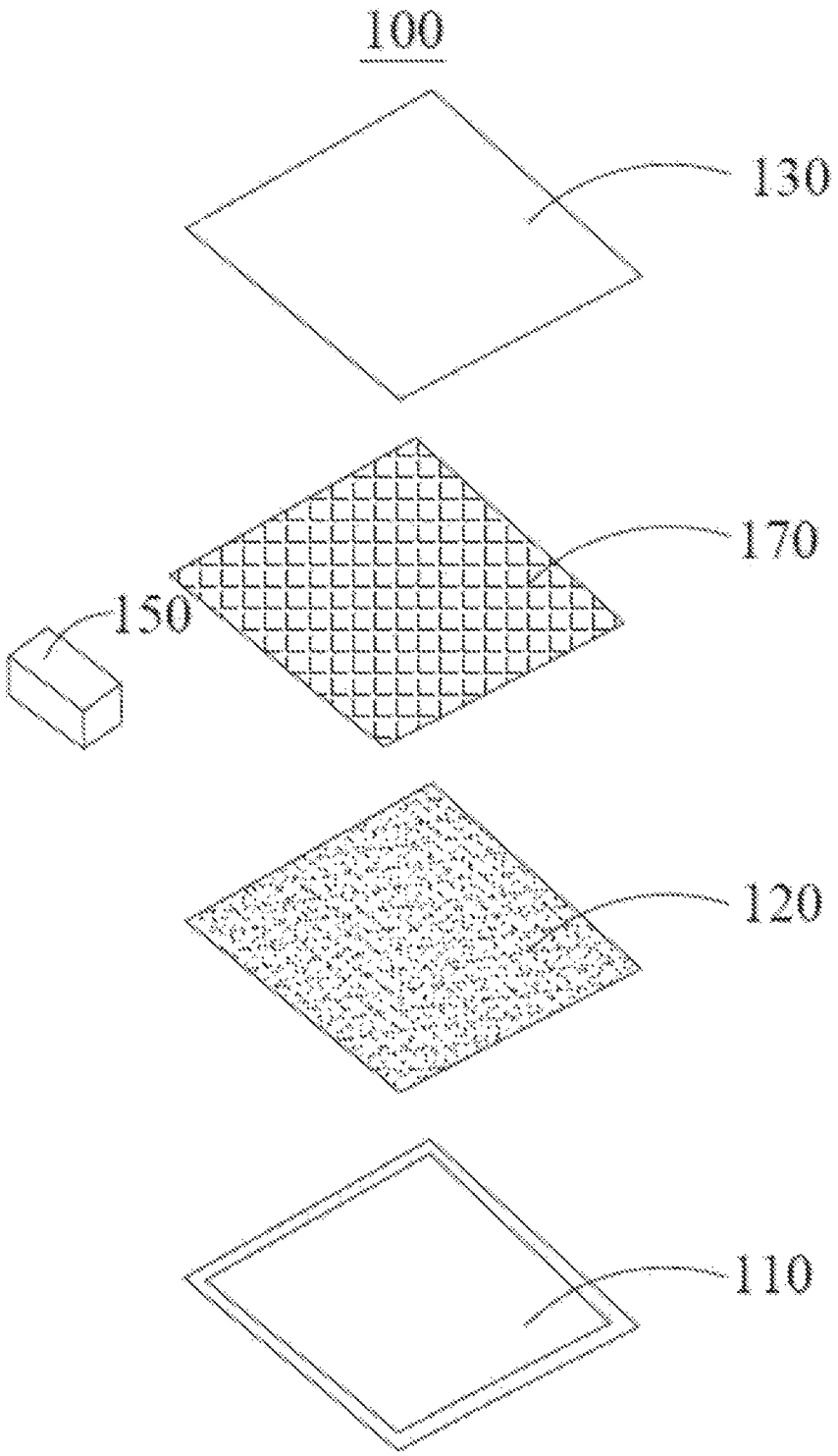
FIG. 8 is another exploded structural diagram of an LED lamp box according to preferred embodiments of the present disclosure.

Further, in order to prevent the light emitted by the LED lamp box 100 during actual operation from affecting shown visual effects due to light emitting or projection, referring to FIG. 8, in the LED lamp box 100, a light absorption layer 120 can further be provided between the lamp box support 110 and the LED light source modules 170, and the light absorption layer 120 is covered with a light absorbing material, so as to prevent the LED light source modules 170 from producing mapping, large flares and reflection that will affect the visual effect of the LED lamp box 100.

A preferred embodiment of the present disclosure further provides a display device. The display device comprises a power supply and the LED lamp box(es) 100, the power supply being electrically connected with the LED lamp box(es) 100 for supplying power to the LED lamp box(es) 100.

In conclusion, for the LED lamp box 100 and the display device provided by the present disclosure, the LED lamp box 100 is provided with a lamp box support 110, a canvas 130, a controller 150 and a plurality of LED light source modules 170; the plurality of LED light source modules 170 are fixed on the lamp box support 110, and the canvas 130 covers the plurality of LED light source modules 170 and is fixed to the lamp box support 110; the LED light source modules 170 are electrically connected with each other; each of the LED light source modules 170 comprises a plurality of LED lamp strips 171 arranged in parallel and lamp-strip PCB connectors 172 for connecting the LED lamp strips 171; the LED lamp strip 171 is provided with an input port and an output port, and each LED lamp strip 171 comprises a plurality of LED lamps 173 connected in series; and the controller 150 is electrically connected with the LED light source modules 170 so as to control the LED lamps 173 in the LED light source modules 170 by scanning the LED light source modules 170 line by line. This design can achieve high gray level, enable the contents to be publicized and expressed in a colorful and dynamic way, and save energy while enabling the LED lamp box 100 to show a colorful dynamic effect.

The descriptions above are only preferred embodiments of the present disclosure, which are not used to limit the present disclosure. For a person skilled in the art, the present disclosure may have various changes and variations. Any modifications, equivalent substitutions, improvements etc., made within the spirit and principle of the present disclosure, shall all be included in the scope of protection of the present disclosure.

It would be apparent to a person skilled in the art that the present disclosure is not limited to the details of the exemplary embodiments described above, and the present disclosure can be implemented in other specific forms without departing from the spirit or essential features of the present disclosure. Accordingly, no matter which aspect is considered, the embodiments should be considered to be exemplary, rather than limitative. The scope of the present disclosure is determined by the appended claims rather than the foregoing description. Therefore, all the variations coming within the meaning and range of equivalency of the claims are intended to be embraced within the present disclosure. Reference signs in a claim should not be regarded as limitations on the claim.

What is claimed is:

1. A light emitting diode (LED) lamp box comprising a lamp box support, a canvas, a controller and a plurality of LED light source modules, the plurality of LED light source modules are fixed on the lamp box support, and the canvas, which covers the plurality of LED light source modules, is fixed to the lamp box support;

the LED light source modules are electrically connected with each other;

each of the LED light source modules comprises a plurality of LED lamp strips arranged in parallel and lamp-strip printed-circuit-board (PCB) connectors configured for connecting the LED lamp strips, each LED lamp strip is provided with an input port and an output port, and each LED lamp strip comprises a plurality of LED lamps connected in series; and the controller is electrically connected with the LED light source modules, so as to control the LED lamps in the LED light source modules by scanning the LED light source modules line by line.

2. The LED lamp box according to claim 1, wherein the plurality of LED light source modules are arranged in a matrix form.

3. The LED lamp box according to claim 2, wherein the LED lamp strips in any two LED light source modules are parallel to each other.

4. The LED lamp box according to claim 1, wherein two adjacent LED light source modules are electrically connected with each other through power lines and/or signal lines.

5. The LED lamp box according to claim 4, wherein each LED light source module comprises two lamp-strip PCB connectors, and the lamp-strip PCB connectors in two adjacent LED light source modules are electrically connected with each other through power lines and signal lines.

6. The LED lamp box according to claim 5, wherein one lamp-strip PCB connector in each LED light source module is electrically connected, by using the power lines, with one lamp-strip PCB connector of the adjacent LED light source module, and the other lamp-strip PCB connector in each LED light source module is connected, by using the signal lines, with the other lamp-strip PCB connector in the adjacent LED light source module.

7. The LED lamp box according to claim 5, wherein in each LED light source module, the two lamp-strip PCB connectors are provided perpendicular to the LED lamp strips, and the two lamp-strip PCB connectors are spaced from each other.

8. The LED lamp box according to claim 1, wherein the LED lamp box further comprises metal wires and fasteners, each metal wire is provided on the LED light source module in an extending direction of the LED lamp strip and fixed to the lamp box support, and each fastener is provided on the metal wire and snap-fixed to the lamp-strip PCB connector.

9. The LED lamp box according to claim 1, wherein the LED lamp box further comprises metal tubes and magnets, each metal tube is provided on the LED light source module in an extending direction of the LED lamp strip and fixed to the lamp box support, and each magnet is provided on the metal tube and magnetically attached to the lamp-strip PCB connector.

10. The LED lamp box according to claim 1, wherein a linear constant-current driving circuit is provided on the lamp-strip PCB connectors, and the linear constant-current driving circuit is electrically connected with the LED lamp strips, so that the LED lamps in the LED lamp strips operate at a constant current.

11. The LED lamp box according to claim 1, wherein a light absorption layer is provided between the LED light source modules and the lamp box support.

12. The LED lamp box according to claim 1, wherein spacings between any two adjacent LED lamps on the LED lamp strip are equal, and the plurality of LED lamp strips are fixed on the lamp box support at equal intervals.

13. The LED lamp box according to claim 1, wherein the input port and the output port of the LED lamp strip are electrically connected with the lamp-strip PCB connectors through pins and/or surface mounted technology (SMT) patches.

14. The LED lamp box according to claim 1, wherein the canvas is snap-fixed to the lamp box support.

15. A display device, comprising a power supply and the LED lamp box according to claim 1, the power supply being electrically connected with the LED lamp box for supplying power to the LED lamp box.

16. The display device according to claim 15, wherein the plurality of LED light source modules are arranged in a matrix form.

17. The display device according to claim 16, wherein the LED lamp strips in any two LED light source modules are parallel to each other.

18. The display device according to claim 15, further comprising metal wires and fasteners, each metal wire is provided on the LED light source module in an extending direction of the LED lamp strip and fixed to the lamp box support, and each fastener is provided on the metal wire and snap-fixed to the lamp-strip PCB connector.

19. The display device according to claim 15, further comprising metal tubes and magnets, each metal tube is provided on the LED light source module in an extending direction of the LED lamp strip and fixed to the lamp box support, and each magnet is provided on the metal tube and magnetically attached to the lamp-strip PCB connector.

20. The display device according to claim 15, wherein a light absorption layer is provided between the LED light source modules and the lamp box support.

* * * * *